US007927171B2

(12) United States Patent
Goszewski et al.

(10) Patent No.: US 7,927,171 B2
(45) Date of Patent: Apr. 19, 2011

(54) INFANT ENTERTAINMENT DEVICE

(75) Inventors: Robert Mark Goszewski, Depew, NY (US); Patrick Ritossa, Orchard Park, NY (US); Robert Sonner, South Wales, NY (US)

(73) Assignee: Mattel, Inc., El Segundo, CA (US)

( * ) Notice: Subject to any disclaimer, the term of this patent is extended or adjusted under 35 U.S.C. 154(b) by 439 days.

(21) Appl. No.: 11/857,960

(22) Filed: Sep. 19, 2007

(65) Prior Publication Data

US 2009/0075549 A1 Mar. 19, 2009

(51) Int. Cl.
*A63H 33/00* (2006.01)
*A63H 13/00* (2006.01)

(52) U.S. Cl. ..... 446/227; 446/330

(58) Field of Classification Search ..... 446/227, 446/278, 330, 331, 362, 359, 366, 367; 40/411, 40/414–421, 427, 429
See application file for complete search history.

(56) References Cited

U.S. PATENT DOCUMENTS

| | | | | | |
|---|---|---|---|---|---|
| 1,453,772 | A | | 5/1923 | Trachtenberg | |
| 1,789,095 | A | * | 1/1931 | Berger | 446/310 |
| 2,467,040 | A | * | 4/1949 | King | 446/358 |
| 2,991,574 | A | | 7/1961 | Trame | |
| 3,024,567 | A | * | 3/1962 | Nifke | 446/304 |
| 3,563,204 | A | | 2/1971 | Szilagyi | |
| 3,770,274 | A | * | 11/1973 | Osak et al. | 273/366 |
| 3,975,845 | A | | 8/1976 | Mellard | |
| 4,223,471 | A | | 9/1980 | Greenberg | |
| 4,285,028 | A | | 8/1981 | Sundin et al. | |
| 4,407,083 | A | * | 10/1983 | Hartgrave | 40/414 |
| 4,775,351 | A | | 10/1988 | Provenzano, Jr. | |
| 4,942,502 | A | | 7/1990 | Ohashi | |
| 4,973,286 | A | * | 11/1990 | Davison | 446/175 |
| 5,261,848 | A | | 11/1993 | Kaplan et al. | |
| 5,303,490 | A | * | 4/1994 | Yang | 40/414 |
| 5,442,869 | A | | 8/1995 | McDarren et al. | |
| 5,584,741 | A | * | 12/1996 | Cheung | 446/300 |
| 5,584,742 | A | * | 12/1996 | Chen | 446/397 |
| D400,619 | S | | 11/1998 | Schultheis et al. | |
| 6,045,430 | A | | 4/2000 | How | |
| 6,113,455 | A | | 9/2000 | Whelan et al. | |
| 6,116,983 | A | | 9/2000 | Long et al. | |
| 6,116,984 | A | * | 9/2000 | Munoz et al. | 446/310 |
| 6,131,318 | A | | 10/2000 | Hsieh | |
| 6,145,227 | A | | 11/2000 | Liao | |
| 6,148,770 | A | | 11/2000 | Lin | |
| 6,189,246 | B1 | * | 2/2001 | Gorthala | 40/446 |
| 6,447,362 | B2 | | 9/2002 | Khamphilavong et al. | |
| 6,699,092 | B1 | * | 3/2004 | Cimerman et al. | 446/153 |
| 6,908,397 | B2 | | 6/2005 | Armbruster et al. | |
| 6,915,604 | B2 | * | 7/2005 | Haywood | 40/414 |
| 7,252,510 | B1 | * | 8/2007 | Basu et al. | 434/169 |
| 2003/0064818 | A1 | | 4/2003 | Drosendahl et al. | |
| 2003/0171065 | A1 | | 9/2003 | Greenberg | |
| 2005/0026536 | A1 | | 2/2005 | Armbruster et al. | |
| 2006/0199468 | A1 | | 9/2006 | Mastrosimone-Gese | |

* cited by examiner

*Primary Examiner* — Gene Kim
*Assistant Examiner* — Alyssa M Hylinski
(74) *Attorney, Agent, or Firm* — Edell, Shapiro & Finnan LLC

(57) ABSTRACT

The present invention relates to an infant entertainment device with a movable object. In one embodiment, the infant entertainment device is a toy aquarium. The infant entertainment device includes a drive mechanism that is operably coupled to the movable object to move the object.

20 Claims, 13 Drawing Sheets

INFANT ENTERTAINMENT DEVICE

FIELD OF THE INVENTION

The present invention relates to an infant entertainment device, and in particular, to an infant entertainment device that includes a movable object.

BACKGROUND OF THE INVENTION

This invention relates to an infant entertainment device, and in particular, to an infant entertainment device that resembles a toy aquarium. Children enjoy conventional toys that have movable parts. In particular, children are typically interested in toys that include moving toy characters. Some conventional toys, such as toy aquariums, are related to aquatic environments and may or may not include movable toy characters.

A need exists for a new toy aquarium that simulates an aquatic environment. A need also exists for a toy aquarium that includes a drive mechanism that easily and simply imparts motion to a toy character or movable object.

SUMMARY OF THE INVENTION

The present invention relates to an infant entertainment device. In particular, the invention relates to a toy aquarium that has a housing that defines a compartment and a toy character or movable object that is movably mounted within the compartment. In one embodiment, the compartment is configured to simulate the appearance of an aquarium. The housing can include a display surface that can be decorated to resemble a specific environment, such as an aquatic environment.

The toy character or movable object in the infant entertainment device is configured to move relative to one or more surfaces of the housing. The toy character is configured so that it can simulate movement. In one embodiment, the toy character can resemble a fish and the movement is that simulating a fish swimming in water.

The infant entertainment device includes a drive mechanism that is operably coupled to the toy character to move one or more portions of the toy character relative to the display surface. In one embodiment, the toy character is a flexible member that has portions that can move relative to other portions of the toy character. The movement of the toy character can be in any direction relative to the display surface. In one embodiment, the toy character can move in a direction substantially parallel to the display surface. In that implementation, the direction of movement is toward and away from the front of the toy aquarium.

The infant entertainment device can include several toy characters or movable objects that are movably mounted in the housing. The directions and types of movements of each of the objects can vary. In one embodiment, the infant entertainment device can include a bubble generating mechanism that is configured to generate bubbles in the liquid in the tank. The infant entertainment device can include an output generating system that has one or more visual output devices and/or an audible output device that are configured to generate visual and/or audible outputs during operation of the device.

BRIEF DESCRIPTION OF THE DRAWINGS

Like reference numerals have been used to identify like elements throughout this disclosure.

DETAILED DESCRIPTION OF THE INVENTION

An infant entertainment device includes a movably mounted object, such as a toy character, and a drive mechanism that is configured to move the movably mounted object. In one embodiment, the infant entertainment device is a toy aquarium and the movably mounted object is an aquatic character. The toy aquarium includes a housing with a compartment and the toy character is disposed in the compartment. In one embodiment, the housing includes a tank or container that is configured to contain a liquid, such as water. In an alternative embodiment, multiple toy characters are movably mounted in the compartment. The toy aquarium includes a drive mechanism that is operably coupled to the toy character.

The terms "movable object" and "toy character" may be used interchangeably to refer to an object that is mounted for movement relative to the infant entertainment device.

Figure 1:
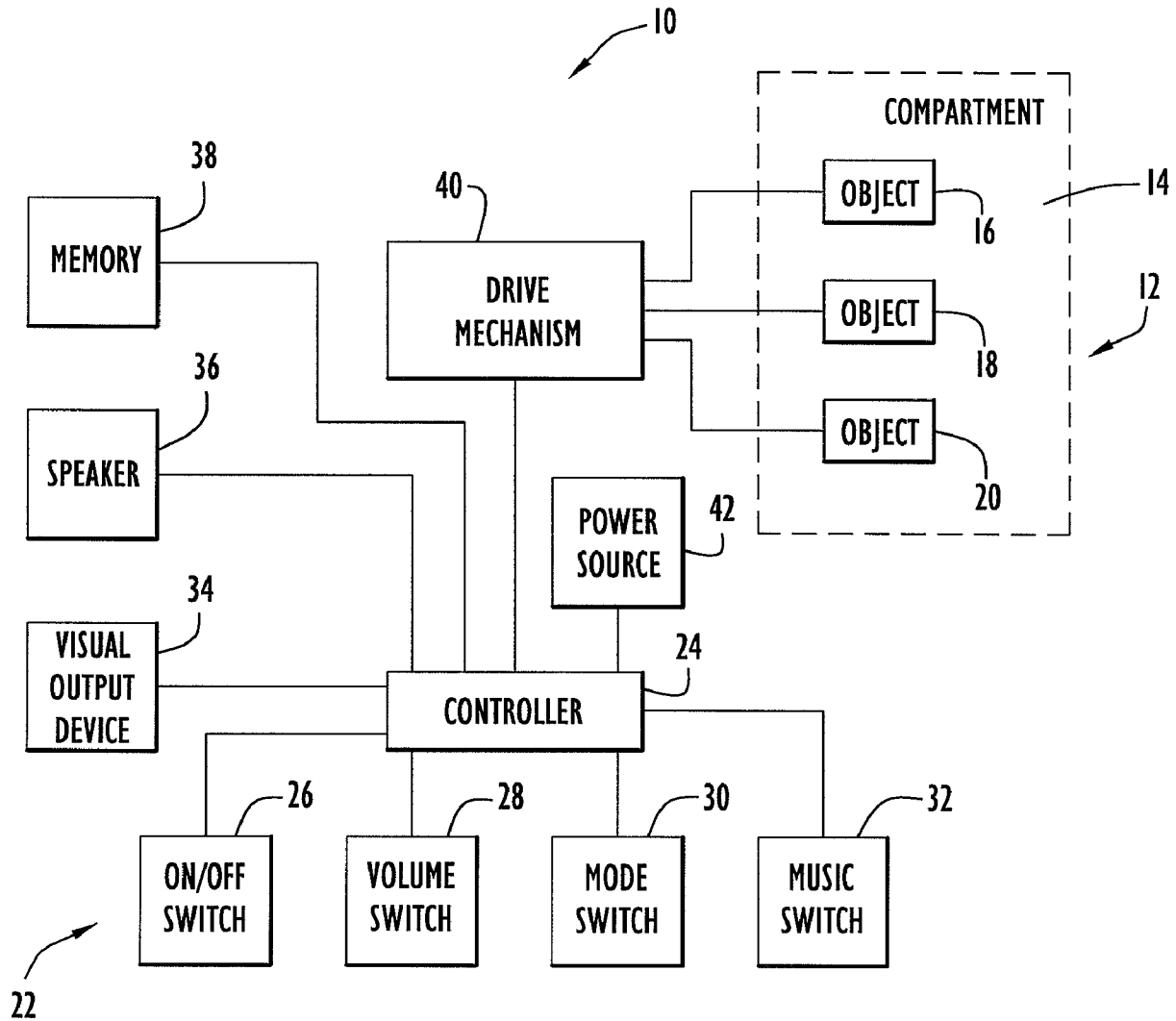
FIG. 1 illustrates a schematic block diagram of an embodiment of an infant entertainment device according to the present invention.

A schematic diagram of an embodiment of an infant entertainment device is illustrated in FIG. 1. In this embodiment, the infant entertainment device 10 includes an entertainment portion 12 and an electronic system 22. The entertainment portion 12 is configured to be appealing and interesting to an infant and/or a young child. The entertainment portion 12 includes one or more movable objects, the movement of which provides actions in which an infant may become interested. In this embodiment, the entertainment portion 12 includes exemplary movable objects 16, 18, and 20. Movable objects 16, 18, and 20 are disposed within a compartment 14 of the device 10. The objects 16, 18, and 20 can be moved in various directions. In other embodiments, the infant entertainment device 10 may include only one movable object.

The electronic system 22 of the infant entertainment device 10 includes a controller or processor 24, which in conjunction with software and programming, controls the function and operation of the elements of the device 10. The controller 24 utilizes a power source 42, such as any type of battery, cell or other source of energy. The processor can be, for example, any conventional processor, such as a conventional integrated circuit.

Several inputs are provided to controller 24. In this embodiment, some exemplary inputs include an on/off switch 26, a volume switch 28, a mode switch 30, and an audible output or music switch 32. While these switches are illustrated for this embodiment, any combination of switches can be utilized with the device 10. A user can manipulate switch 26 to turn the device on and off, switch 28 to adjust the volume of the audible outputs generated by the device 10, switch 30 to change the mode of operation for the device 10, and switch 32 to change the audible outputs, such as music, that are played by the device 10. Some examples of these types of switches are discussed in greater detail below.

The electronic system 22 also includes an output generating system which in this embodiment, includes a visual output device 34, such as a light source or light emitting diode (LED), and a sound generating device, such as a speaker 36 or other suitable audio transducer, through which audible outputs including music and sound effects, such as bubbles, can be generated. The system 22 may include one or more visual output devices located around the device 10. The visual output devices may change colors, fade in and out, and be illuminated in alternating patterns.

The system includes a memory component 38 that is connected to the processor 24. The memory 38 can be any conventional memory, such as a disk drive, cartridge, or solid state memory, in which various audio outputs, such as music, selections, sound effects, and speech, can be stored.

The infant entertainment device 10 also includes a drive mechanism 40. In this embodiment, the drive mechanism 40 is operably coupled to the objects 16, 18, and 20 to move them. In one embodiment, the drive mechanism 40 is configured to move each of the objects 16, 18, and 20 in a different manner. For example, object 16 may be moved in a reciprocating arcuate path in a vertical plane, object 18 may be moved in a reciprocating linear path along a vertical plane, and object 20 may be moved substantially perpendicularly relative to the same vertical plane or in other words, into and out of the plane.

The infant entertainment device 10 can be any type of device that is interesting for an infant to watch and/or listen to. Such a device 10 may generate audible and/or visual outputs that stimulate one or more of an infant's senses. In one embodiment, the infant entertainment device 10 may be a toy aquarium.

Figure 2:
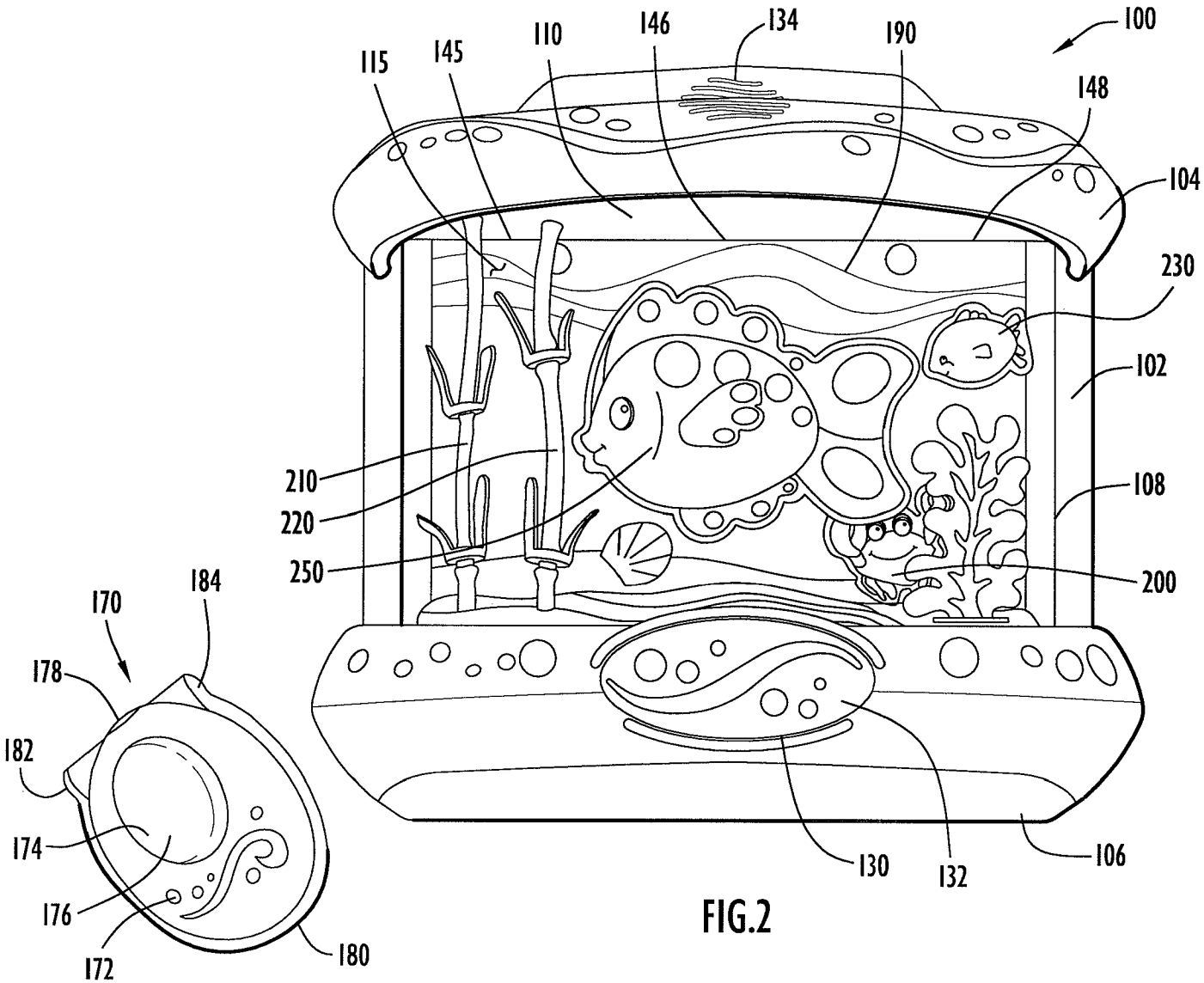
FIG. 2 illustrates a front view of an embodiment of an infant entertainment device according to the present invention.

A front view of an embodiment of an infant entertainment device according to the invention is illustrated in FIG. 2. In this embodiment, the infant entertainment device or toy 100 is configured to resemble a toy aquarium. The device 100 includes a housing 102 that is formed by coupling a front portion 104 and a rear portion 106 together using conventional fasteners, such as bolts or screws. The front portion 104 and the rear portion 106 can be made of molded plastic. The front portion 104 defines an opening 108 in which a transparent or see-through portion 110 is disposed. The transparent portion 110 allows a child to look into the interior region or compartment 115 that is formed by the housing 102. The front portion 104, the rear portion 106, and the transparent portion 110 collectively form the compartment 115 in which one or more movable objects can be located.

A lower part of the housing 102 includes an opening 130 in which an actuator 132, such as a button, is located. The actuator 132 can be actuated or pressed by a user to turn the electronic system of the device 100 on and off as desired. The housing 102 also includes several openings 134 through which audible outputs generated by a speaker can be heard. The locations and configurations of the openings 130 and 134 and button 132 can vary between different embodiments.

The infant entertainment device 100 includes a remote control 170 that can be used to control the operation of the device 100. The remote control 170 can include a body 172 with an opening 174 in which a button 176 is disposed. The remote control 170 can include an internal electronic system that has a switch associated with button 176 so that when button 176 is pressed, the switch is closed and a signal is generated. The remote control 170 includes a wireless transmitter, such as an infrared (IR) transmitter, and a plastic cover 178 that is disposed proximate to the transmitter. The transmitter can be a radio frequency (RF) transmitter or other wireless communication transmitter in different embodiments. The transmitter can be used to send wireless control signals to the housing 102 of the device 100. In this embodiment, a handle 180 is pivotally coupled to the body 172 at ends 182 and 184. Handle 180 can be used to transport and/or support the remote control 170.

The infant entertainment device 100 also includes several objects, and at least one of the objects is movable. In this embodiment, the movable objects resemble items typically found in an aquatic environment. The particular items described below are exemplary objects that can be utilized with the device 100. In various embodiments, the movable objects can resemble any type of item.

Referring to FIG. 2, the device 100 includes movable objects 200, 210, 220, 230, and 250 that are disposed in the compartment 115 formed by the front portion 104, the rear portion 106, and the transparent portion 110. The location of the movable objects 200, 210, 220, 230, and 250 behind the transparent portion 110 creates the appearance that the objects are disposed in the simulated aquatic environment when the infant entertainment device 100 is viewed from one of the sides or from the front. The housing 102 includes a display surface 190 on which indicia may be included to create a particular environment. In this embodiment, the indicia on display surface 190 resembles that of an aquatic environment.

The first movable object 200, which in this case resembles a crab, is pivotally mounted for arcuate movement within a substantially vertical plane. Each of the second and third movable objects 210 and 220, which in this case both resemble plant-like structures, are pivotally mounted for movement along a substantially longitudinal axis. A fourth movable object 230, resembling a fish, is mounted for movement along a linear path with a substantially reciprocating motion. A fifth movable object 250, resembling a fish, is mounted for movement relative to the display surface 190. The motion of each of the movable objects is discussed in greater detail below. When the device 100 is turned on, the movable objects 200, 210, 220, 230, and 250 are moved by a drive mechanism as described below.

The infant entertainment device 100 also includes several light sources or light emitting devices 145, 146, and 148, such as LEDs, which can alternatively turn on and off and fade in and out as desired during operation of the device 100. In addition, there may be one or more LEDs of the same or different color located along the lower surface of the compartment 115. The locations of the light sources can vary in various embodiments of infant entertainment devices.

Figure 3:
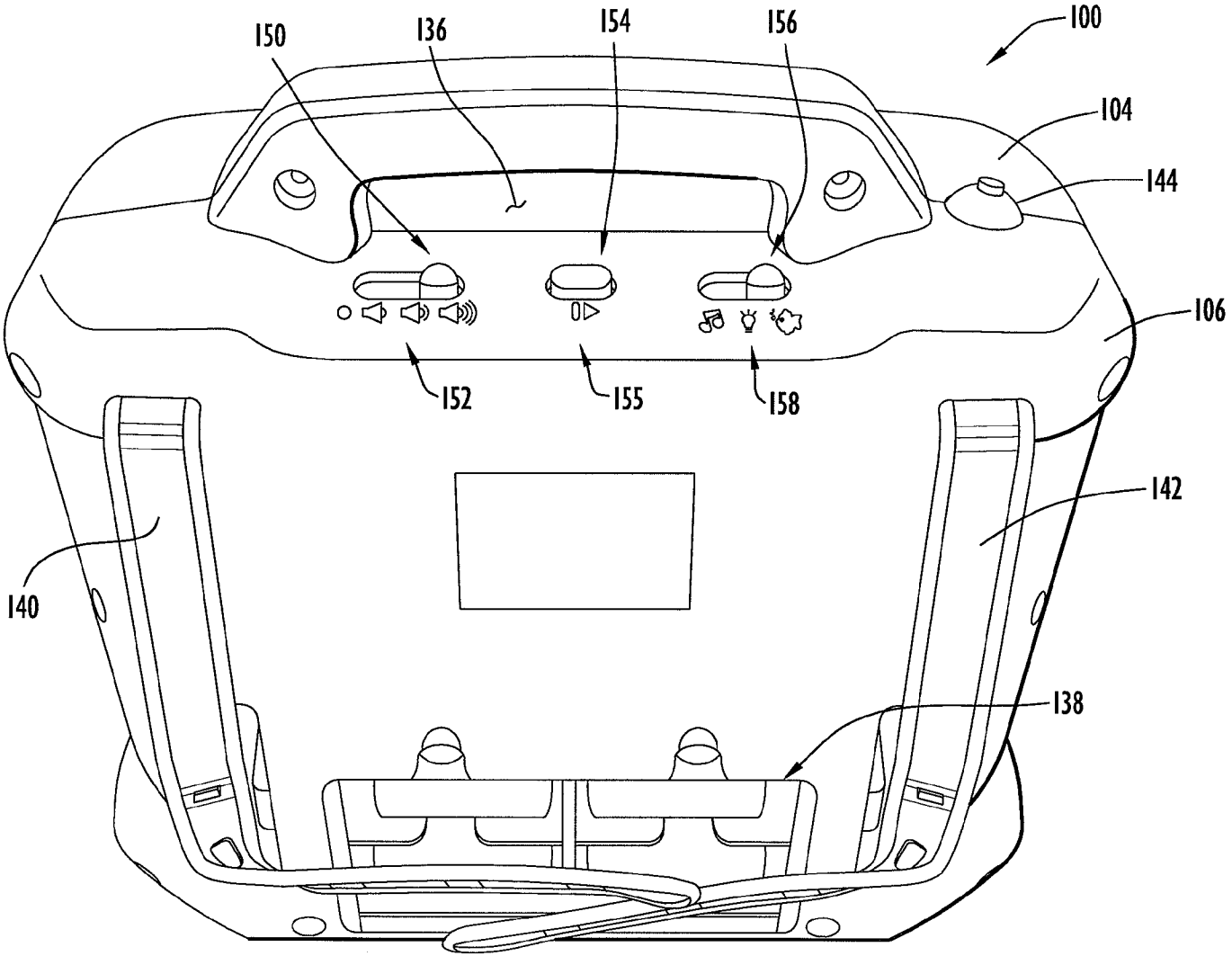
FIG. 3 illustrates a rear view of the infant entertainment device illustrated in FIG. 2.

Referring to FIG. 3, a rear view of the infant entertainment device 100 is illustrated. As previously mentioned, the device 100 may include a front portion 104 and a rear portion 106. The rear portion 106 includes a recess 136 that can be used as part of a handle to transport the device 100. The rear portion 106 also includes a battery compartment 138 in which one or more batteries or other power sources can be located. Conventional straps 140 and 142 are coupled to the rear portion 106 and manipulatable to mount the device 100 to an infant support structure, such as a crib. A wireless receiver may be provided to receive signals from the remote control 170. A plastic cover 144 may be provided proximate to the wireless receiver.

In this embodiment, the device 100 includes several switches. In particular, the device 100 includes a multi-position volume switch 150 with indicia 152 that designate the different volume levels that can be selected for the audible outputs. The device 100 also includes a music selection switch 154 with indicia 155. When switch 154 is pressed, the audible output being played, which can be a song, is interrupted and the processor advances to the next audible output selection, which is generated. The device 100 also includes a mode switch 156 with indicia 158 representing the different modes of operation. The modes include a musical mode (in which music only is played), a lights mode (in which light is generated in addition to the music), and an object moving mode (in which the objects move in addition to the lights and the music). The different modes of operation, quantity of switches, and resulting outputs can vary depending in different embodiments.

Figure 4:
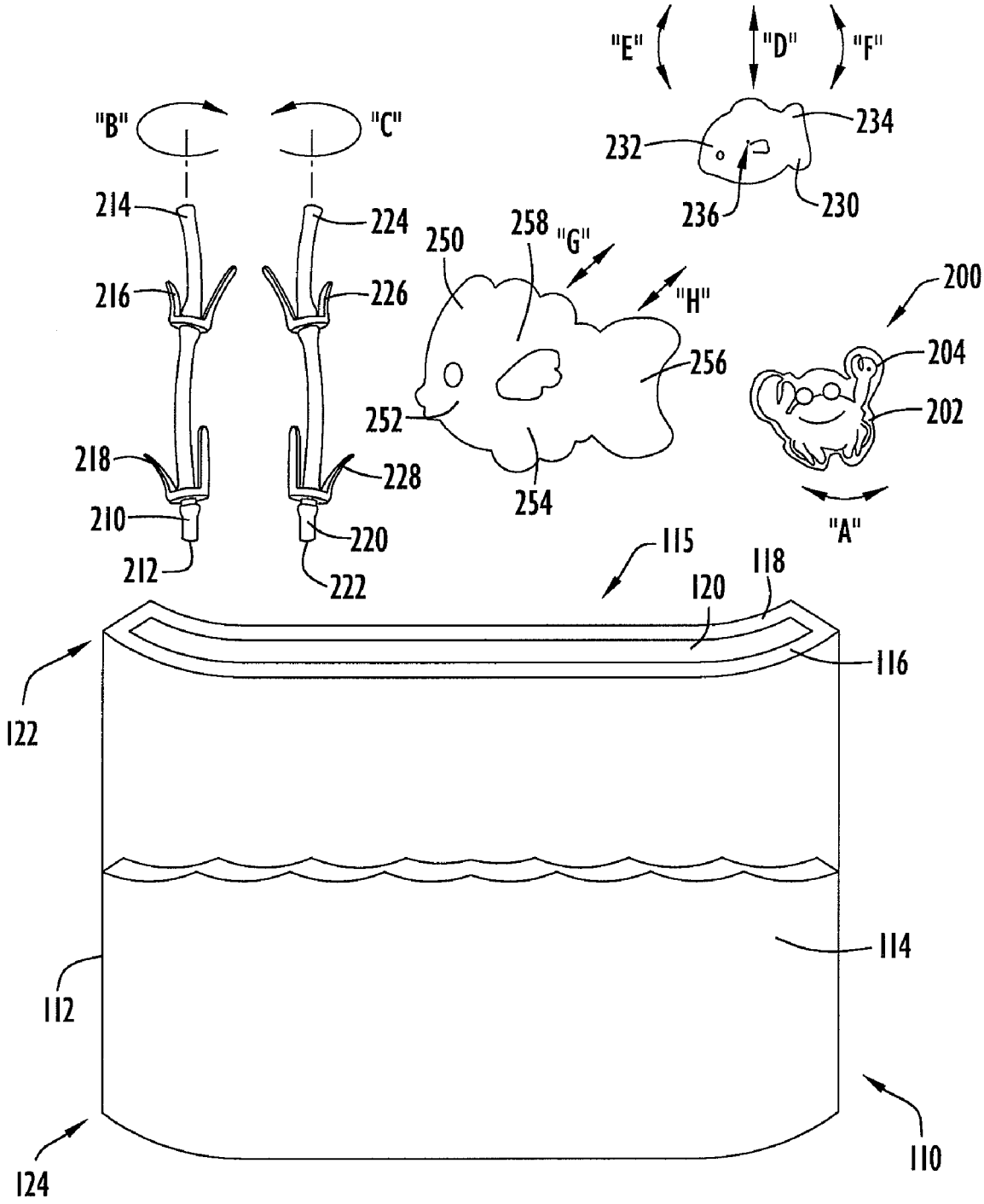
FIG. 4 illustrates an exploded view of some of the components of the infant entertainment device illustrated in FIG. 2.

Referring to FIG. 4, several of the components of the infant entertainment device 100 are illustrated. The transparent portion 110 is illustrated in FIG. 4 along with the movable objects. In this embodiment, the transparent portion 110 includes a container 112 formed by an outer wall 116 and an inner wall 118 that define a chamber or tank 120 therebetween in which a liquid 114 can be disposed. The outer wall 116 and the inner wall 118 can be formed of a plastic material. The amount of liquid 114 in the chamber 120 can vary, provided that a sufficient amount is present to create the appearance of an aquatic environment. The container 112 has an upper end 122 and a lower end 124 that are coupled to the front housing 104 of the device 110 to seal the liquid 114 within the container 112. The liquid 114 in the container 112 can be any type of liquid, such as water or a mixture of water and propylene glycol. The movable objects 200, 210, 220, 230, and 250 are disposed in the compartment 115 that is behind the transparent portion 110, thereby remaining dry while creating the appearance that the objects are in the liquid 114.

The particular types of movement of each of the movable objects are illustrated in FIG. 4. Movable object 200 includes a body 202 that is mounted for arcuate movement along the directions of arrow "A" about point 204. Movable object 210 is an elongate member that is pivotally mounted at ends 212 and 214 for rotation about a longitudinal axis along the direction of arrow "B." Loosely mounted objects 216 and 218 move relative to the elongate member as object 210 rotates. Similarly, movable object 220 is an elongate member that is pivotally mounted at ends 222 and 224 for rotation about a longitudinal axis along the direction of arrow "C." Loosely mounted objects 226 and 228 move relative to the elongate member as object 220 rotates.

Movable object 230 includes a front portion 232 and a rear portion 234. The object 230 is movable about point 236 which moves upwardly and downwardly along the direction of arrow "D." At the same time, the front portion 232 and the rear portion 234 reciprocate in arcuate patterns along the directions of arrows "E" and "F," respectively. The particular components of the drive mechanism imparting motion to movable object 230 are described below.

Movable object 250 includes a first portion 252, a second portion 254, and a third portion 256. The object 250 includes a front surface 258 which includes ornamentation or indicia resembling a fish, which can be achieved by molding or the applicable of a sticker to the object 250. Object 250 is made of flexible material, such as plastic, that allows the object to bend and be disposed in different curved positions.

The object 250 is configured so that at least one of the first portion 252, the second portion 254, and the third portion 256 move relative to each other. In one embodiment, the second portion 254 can move back and forth along the directions of arrow "G" and the third portion 256 can move back and forth along the directions of arrow "H."

Figure 5:
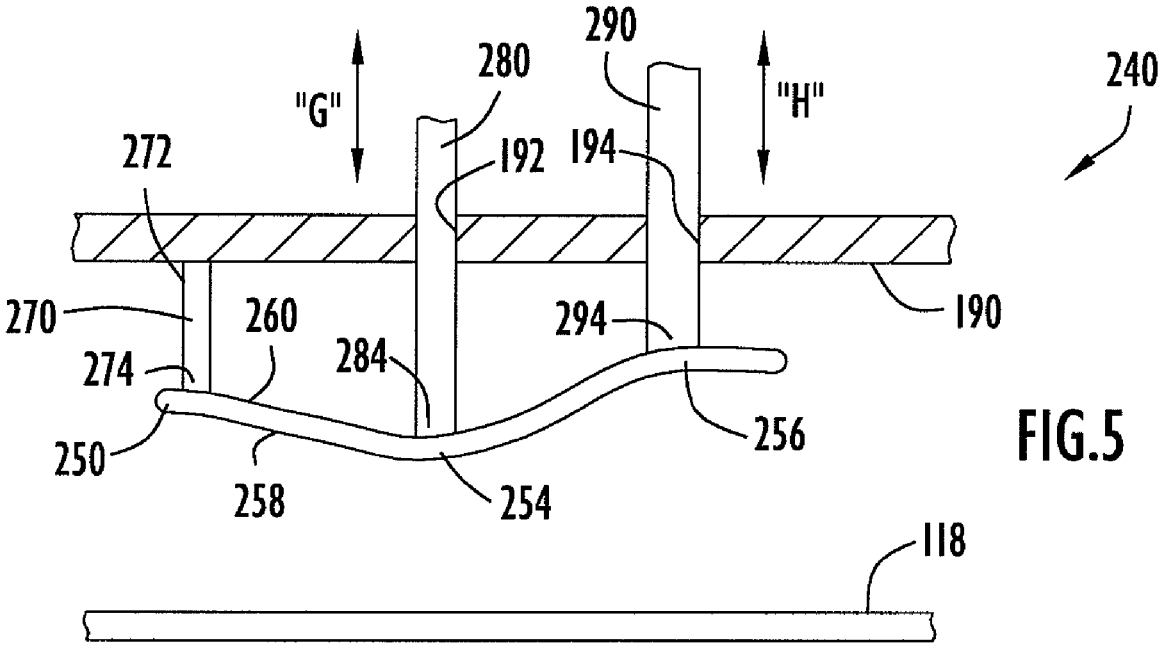
FIG. 5 illustrates a top partial cross-sectional view of some of the components of the infant entertainment device illustrated in FIG. 2, shown in a first configuration.
Figure 6:
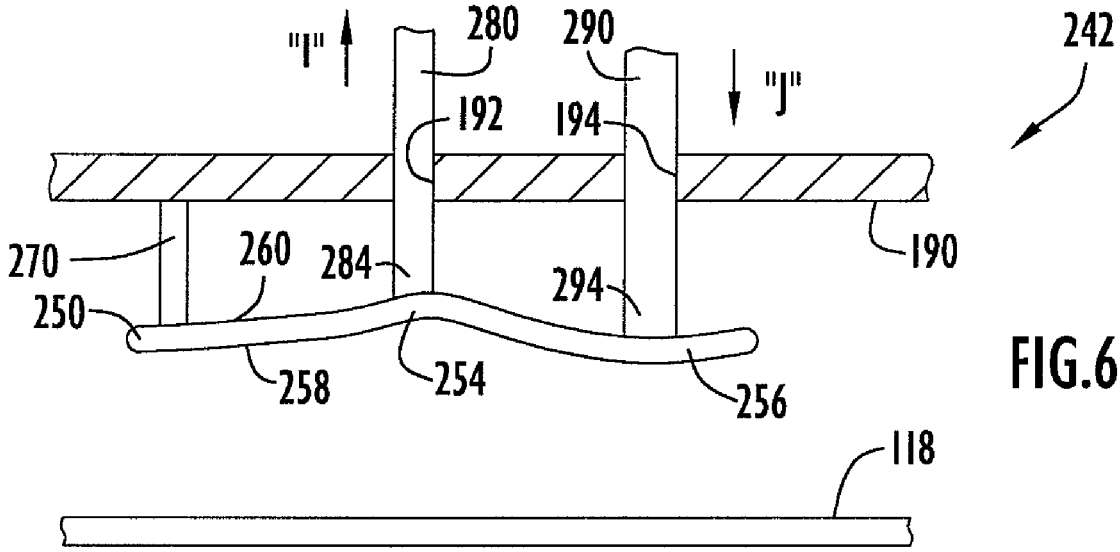
FIG. 6 illustrates a top partial cross-section view of some of the components of the infant entertainment device illustrated in FIG. 2, shown in a second configuration.

Referring to FIGS. 5 and 6, exemplary movements of the movable object 250 are illustrated in the partial cross-sectional top views shown. In FIG. 5, the movable object 250 is illustrated in a first configuration 240 and in FIG. 6, the movable object 250 is illustrated in a second configuration 242, which is different than first configuration 240. Movable object 250 is located between the display surface 190 and portion of the container, which in FIG. 5 is shown as inner wall 118.

The first portion 252 of the movable object 250 is coupled to a support 270 which is also coupled to the display surface or wall 190. The support 270 includes a first end 272 coupled to the display surface 190, such as by molding, an adhesive or a connector. The second end 274 is coupled to the object 250 using a snap-fit connection or other connecting arrangement. The location at which the second end 274 is coupled can be referred to as a connection area or location.

The movable object 250 is coupled to a drive element or linkage 280 proximate to second portion 254. As shown, a second end 284 of the drive element 280 is coupled to the movable object 250. Similarly, the movable object 250 is coupled to drive element or linkage 290 proximate to third portion 256. The second end 294 of the drive element 290 is coupled to the movable object 250. The location at which the second ends 284 and 294 are coupled to the object 250 can be referred to as connection areas or locations. The couplings can occur in a variety of ways.

As shown in FIG. 5, the drive element or linkage 280 extends through an opening 192 formed in display surface or wall 190. Drive element 280 is movable along the directions of arrow "G" and as a result, such movement causes the second portion 254 of the movable object 250 to move along the directions of arrow "G" as well.

Similarly, the drive element or linkage 290 extends through an opening 194 formed in the display surface or wall 190. Drive element 290 is movable along the directions of arrow "H" and such movement causes the third portion 256 of the movable object 250 to move along the directions of arrow "H" as well. As will be described in greater detail below, the drive elements 280 and 290 can be positioned to be offset and out of phase with each other, at which point the second portion 254 and the third portion 256 of movable object 250 can be at different positions with respect to each other and with respect to the display surface 190 and to the inner wall 118.

Referring to FIG. 6, the movable object 250 is illustrated as being in a different configuration 242 than the configuration 240 illustrated in FIG. 5. In this configuration 242, the drive mechanism has been operated to impart movement to the drive elements 280 and 290. In particular, drive element 280 is moved along the direction of arrow "I" so that the second portion 254 is closer to the display surface 190 than it was in configuration 240 (see FIG. 5). Similarly, drive element 290 is moved along the direction of arrow "J" so that the third portion 256 is farther away from the display surface 190 than it was in configuration 240. Thus, each of the drive elements 280 and 290 is mounted for reciprocating movement and accordingly, the second portion 254 and the third portion 256 reciprocate while the first portion 252 remains fixed in its position relative to the display surface 190. The movement of portions 254 and 256 of the movable object 250 is back and forth along a direction that is substantially perpendicular to the display surface 190 or inner wall 118. This movement is also along a direction that is substantially perpendicular to a front surface 258 and a rear surface 260 of the object 250.

In one embodiment, one portion of the movable object may be fixed relative to the display surface and only one portion of the movable object may be movable relative to the display surface. In another embodiment, the movable object may include three different portions that are each coupled to a movable drive element or linkage, and as a result, all three different portions are moved.

Figure 7:
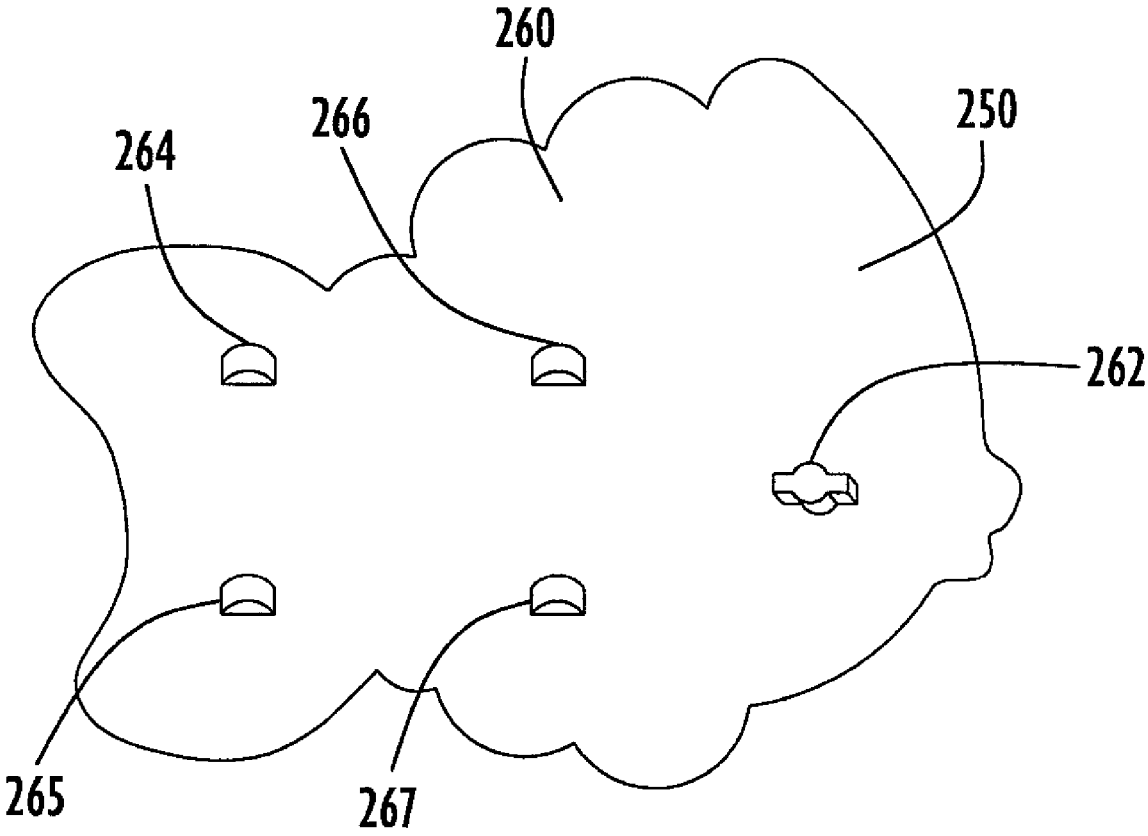
FIG. 7 illustrates a rear view of a movable object of the infant entertainment device illustrated in FIG. 2.
Figure 8:
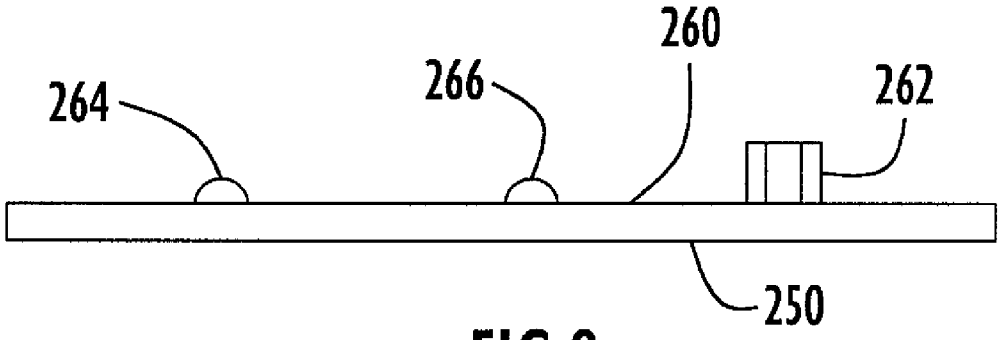
FIG. 8 illustrates a top view of the movable object illustrated in FIG. 7.

Referring to FIGS. 7 and 8, rear and top views of an embodiment of the movable object 250 are illustrated. Movable object 250 includes a rear surface 260 which is opposite the front surface 258. A projection 262 extends outwardly from the rear surface 260. Projection 262 is configured to be coupled to the support 270, such as by a snap fit arrangement. Several sets or pairs of couplers 264, 265, 266, and 267 can be provided along the rear surface 250 to provide structures to which drive elements 280 and 290 can be coupled. In this embodiment, the movable object 250 is made of a molded plastic material and projection 262 and couplers 264, 265, 266, and 267 are formed integrally therewith. A label, sticker or other ornamentation can be applied to the front surface 258 of the movable object 250.

Figure 9:
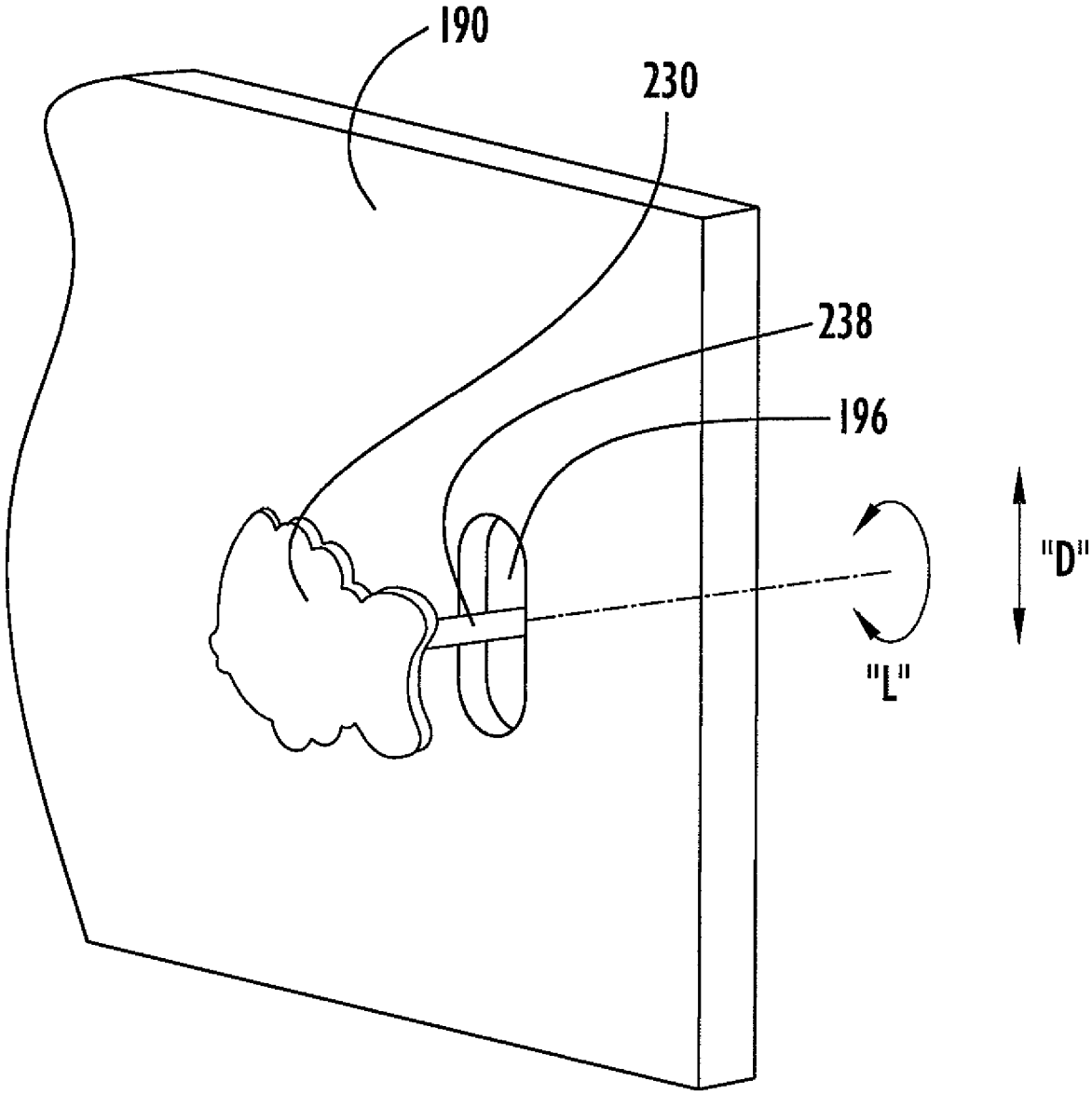
FIG. 9 illustrates a perspective view of another movable object of the infant entertainment device illustrated in FIG. 2.

Referring to FIG. 9, movable object 230 is illustrated. In this embodiment, movable object 230 has a coupler 238 connected thereto. The coupler 238 is connected to the drive mechanism which is configured to move the coupler 238, and as a result, the movable object 230, along the directions of arrow "D" and in an arcuate manner along the directions of arrow "L." The display surface or wall 190 includes a slot 196 formed therein through which the coupler 238 extends and is movable.

Figure 10:
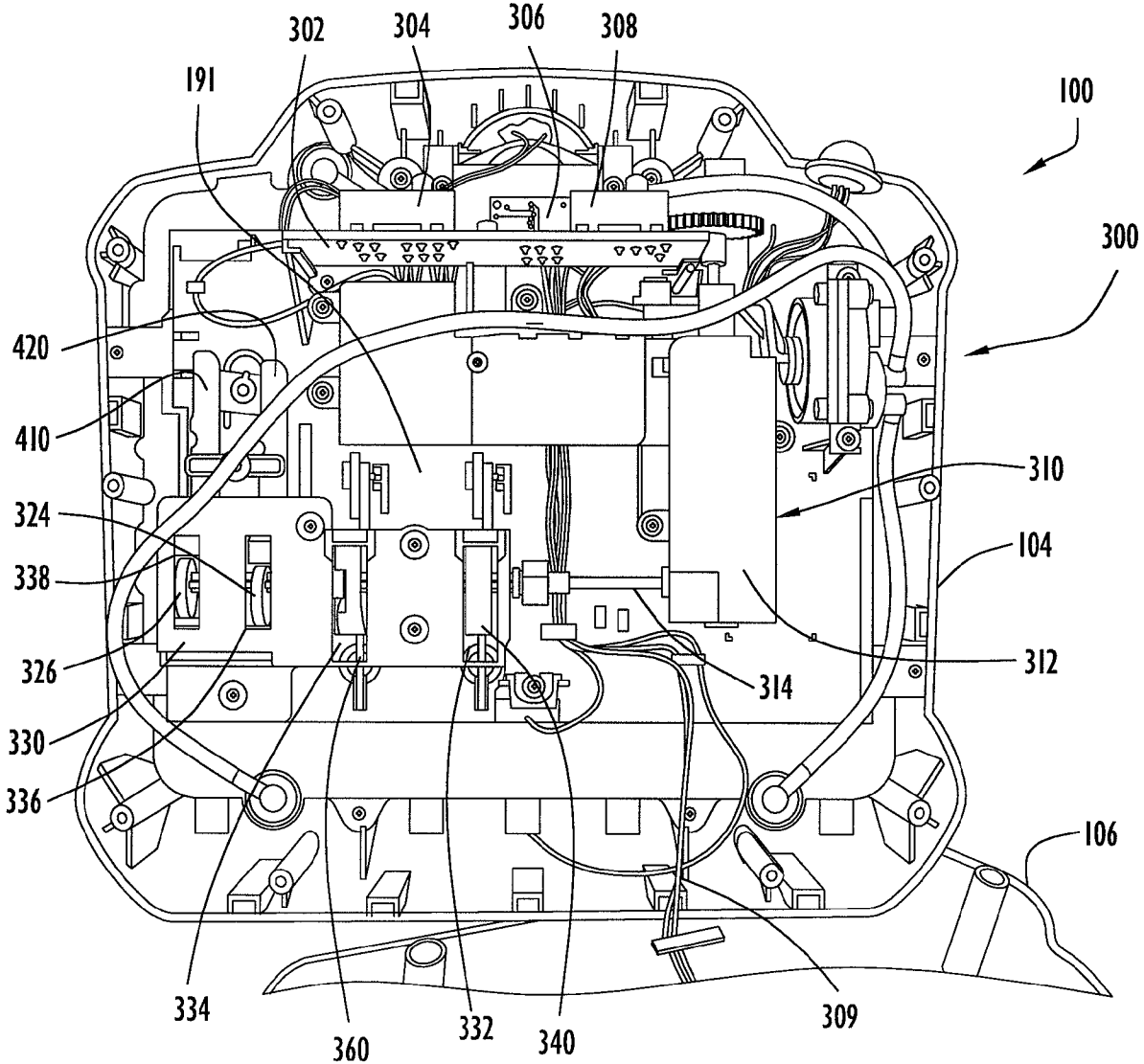
FIG. 10 illustrates a rear view of the internal components of the infant entertainment device illustrated in FIG. 2.
Figure 11:
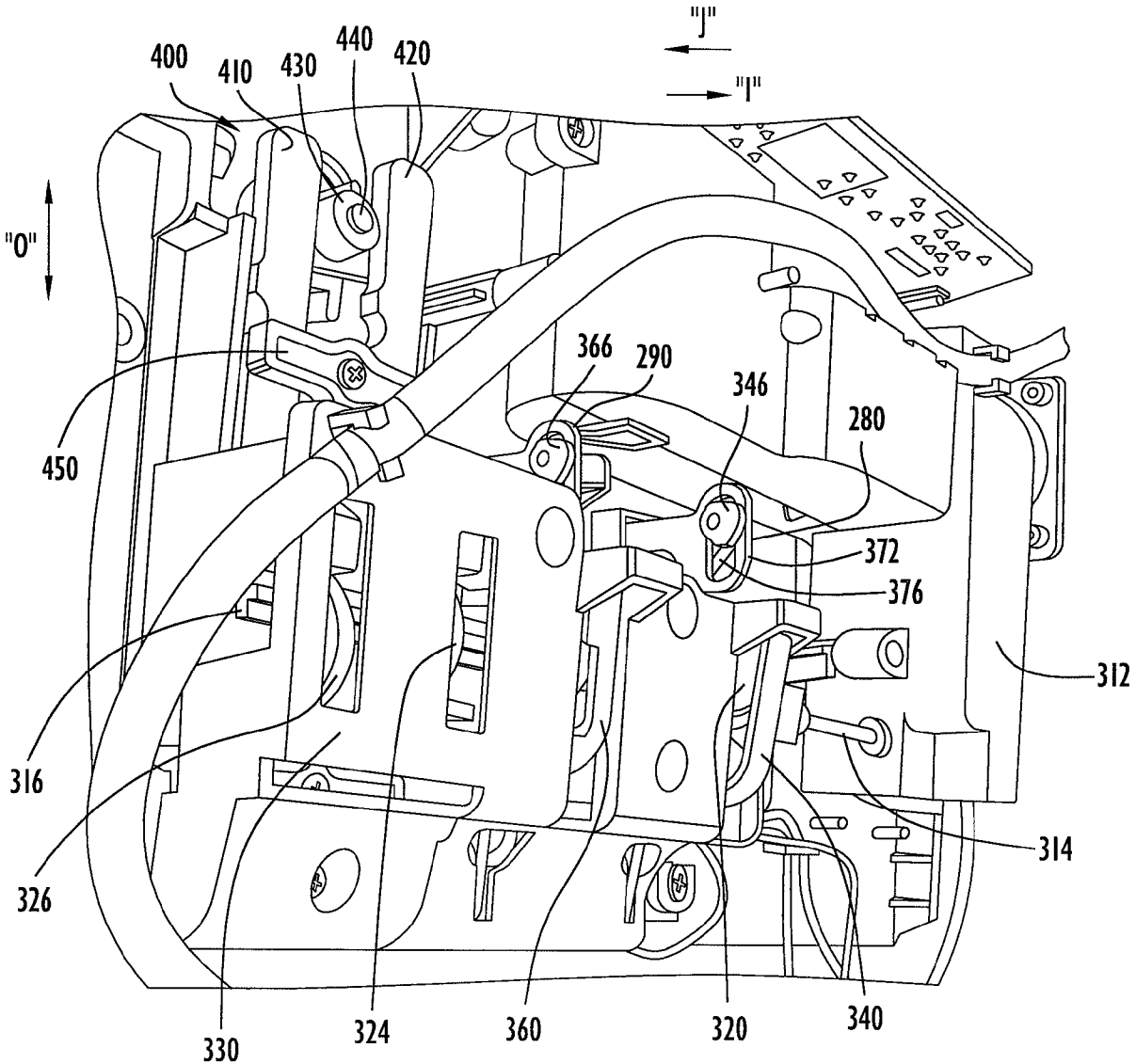
FIG. 11 illustrates a perspective view of some of the components of a drive mechanism of the infant entertainment device illustrated in FIG. 2.
Figure 12:
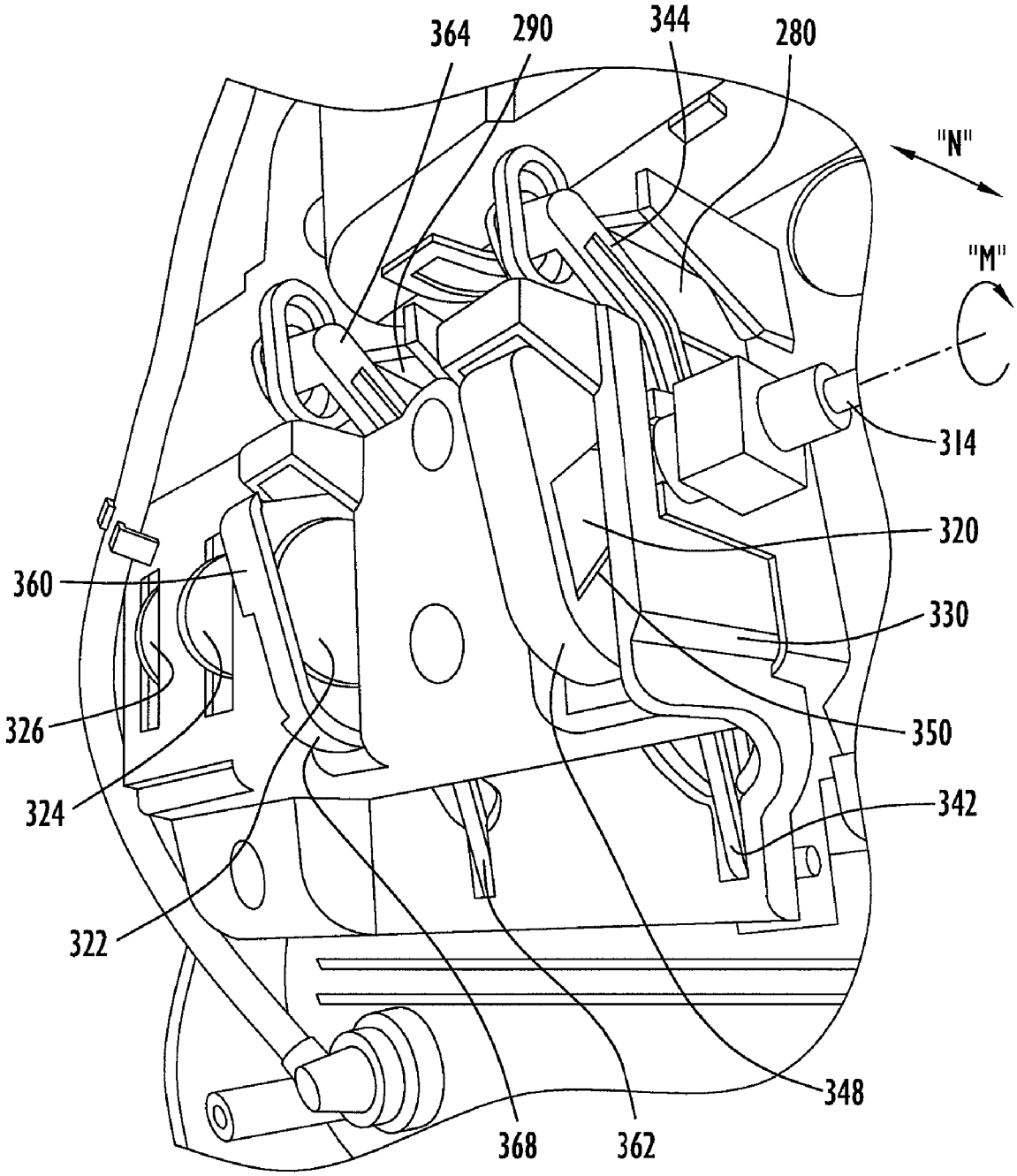
FIG. 12 illustrates a perspective view of some of the components of a drive mechanism of the infant entertainment device illustrated in FIG. 2.

Referring to FIGS. 10-12, an embodiment of a drive mechanism and electronic system of the infant entertainment device is illustrated. In this embodiment, the infant entertainment device 100 includes an electronic system 300 which controls the operation of the various components of the device 100. The electronic system 300 includes a control board 302 to which switches 304, 306, and 308 are connected. Switches 304, 306, and 308 are associated with switches 150, 154, and 156, respectively. Wiring 309 extends between the control board 302 and the power source.

Figure 13:
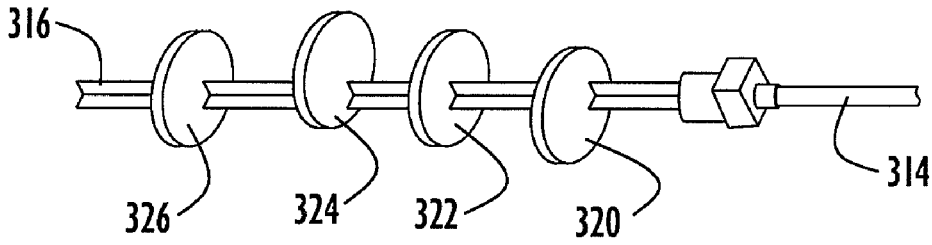
FIG. 13 illustrates a perspective view of an embodiment of a drive shaft of the infant entertainment device illustrated in FIG. 2.

The electronic system 300 includes a drive mechanism 310 which includes a housing 312 in which a motor is located. The drive mechanism 310 includes a drive or output shaft 314 that is operably coupled to the motor for rotation about its longitudinal axis. Shaft 314 can also be referred to as a rotatable shaft. Referring to FIG. 13, an embodiment of output shaft 314 is illustrated. In this embodiment, the output shaft 314 has several cam members 320, 322, 324, and 326 located along its length. The shaft 314 includes a distal end 316 with an X-shaped cross-section. Each of the cam members 320, 322, 324, and 326 includes an outer engagement surface and is offset about the longitudinal axis of the output shaft 314 with respect to an adjacent cam member. In other words, as the shaft 314 rotates, the cam members are moved cyclically and the positions of the cam members 320, 322, 324, and 326 are such that they are out of cycle with respect to each other and as a result, as disposed in different position with respect to each other. Accordingly, the object portions or objects moved by the cam members are disposed at different positions and distances relative to surfaces during operation of the drive mechanism. The distal portion 316 and the cam members 320, 322, 324, and 326 can be molded plastic an integrally molded together. In other embodiments, the cam members 320, 322, 324, and 326 can be formed separately from and coupled to the shaft 314.

As illustrated in FIGS. 10-12, the drive mechanism 310 includes a housing 330 through which the output shaft 314 extends and in which the cam members 320, 322, 324, and 326 are located. The housing 330 includes openings 332, 334, 336, and 338 through which portions of cam members 320, 322, 324, and 326 extend, respectively, as the output shaft 314 rotates. Cam members 320 and 322 are used to impart movement to the drive elements 280 and 290 coupled to the movable object 350. As shown in FIGS. 11 and 12, the drive elements 280 and 290, which extend through display surface 190, are coupled to drive members 340 and 360, respectively. Drive members 340 and 360 are pivotally mounted at their respective lower ends 342 and 362 and are engaged by cam members 320 and 322, respectively. Cam member 320 engages drive member 340 (see FIG. 11) and cam member 322 engages drive member 360 (see FIG. 12).

As the output shaft 314 rotates, the positions of cam members 320 and 322 change and when one of the cam members 320 and 322 extends rearwardly away from the display surface 190, it pushes against its respective drive member and pivots it rearwardly. For example, as output shaft 314 rotates along the direction of arrow "M" in FIG. 12, cam member 322 moves drive member 360 rearwardly relative to housing 330 and portions of the drive member 360 and cam member 322 extend through opening 334 in the housing 330 (see FIG. 12). As drive member 360 pivots rearwardly about its lower end 362, the coupler 366 at its upper end 364 also moves rearwardly along the direction of arrow "N." The coupler 366 is connected to the drive element 290 and as the coupler 366 moves rearwardly and causes the drive element 290, and the corresponding portion of the object 350, to move in the same direction (along the direction of arrow "I" in FIGS. 6 and 11). As the output shaft 314 continues to rotate, the cam member 322 is rotated and it moves toward the display surface 190 along the direction of arrow "J." Such movement causes the drive element 290 to move along the direction of arrow "J" in FIG. 6 and in FIG. 11, which results in the corresponding portion of the movable object 350 moving in the same direction toward the front of the housing 102.

Similarly, as output shaft 314 rotates, cam member 320 moves drive member 340 rearwardly relative to the display surface 190 and the housing 330 and drive member 340 and cam member 320 extend through opening 332 in housing 320 (see FIG. 11). As drive member 340 pivots rearwardly about its lower end 342, the coupler 346 at its upper end 344 also moves rearwardly. The coupler 346 is connected to the drive element 280 and as the coupler 346 moves rearwardly and causes the drive element 280 to move in the same direction along arrow "I." As the output shaft 314 continues to rotate, the cam member 320 is rotated and it moves toward the display surface 190 along the direction of arrow "J." Such movement causes the drive element 280 to move along the direction of arrow "I" in FIGS. 6 and 11, which results in the corresponding portion of the movable object 350 moving in the same direction. The forward and rearward movement of the cam members 320 and 322 and the corresponding drive members 340 and 360 continues while the shaft 314 rotates. Thus, rotational movement of the drive shaft 314 and its cam members results in linear, reciprocating movement of portions of the movable object 350.

Figure 14:
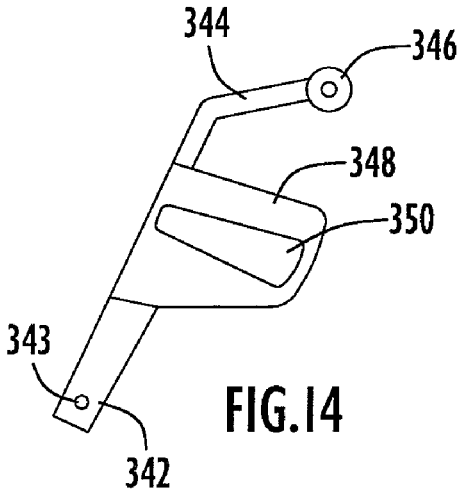
FIGS. 14-16 illustrate side and end views of a drive member of the infant entertainment device illustrated in FIG. 2.
Figure 15:
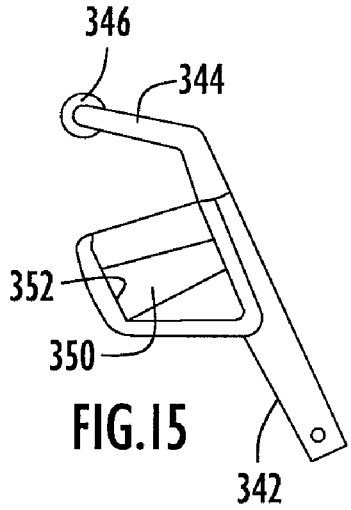
Figure 16:
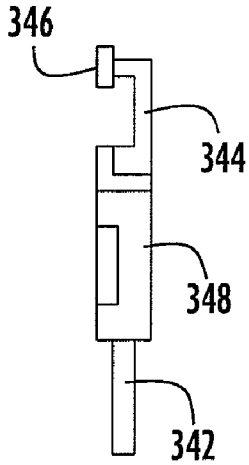

Referring to FIGS. 14-16, an embodiment of a drive member according to the present invention is illustrated. In this embodiment, the drive member 340 includes a lower end 342 with an opening 343 through which a connector may be inserted to pivotally mounted the drive member 340. The drive member 340 also includes an upper end 344 that has a coupler 346 integrally formed therewith. The coupler 346 keeps the drive element 280 coupled to the drive member 340. The drive member 340 also includes a body 348 that has a slot 350 formed therein. A wall 351 along the perimeter of the body 348 defines a contact surface 352 that is engaged by cam member 320 during operation of the device 100. In this embodiment, wall 351 extends along three sides of the body 348 (see FIG. 15). The drive members 340 and 360 can be made of molded plastic material. Drive member 360 can have a similar configuration, including a body 368.

Figure 17:
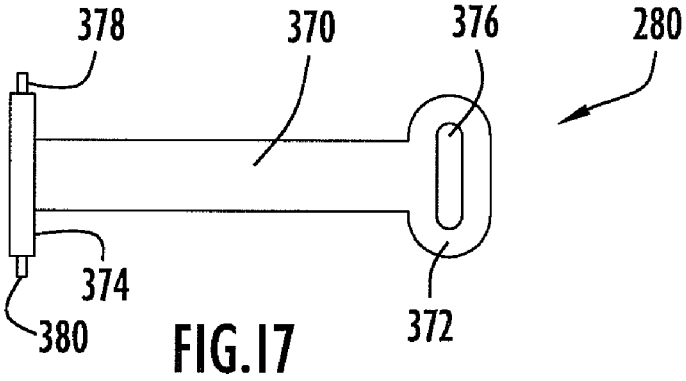
FIGS. 17-19 illustrate side, top and end views of a linkage or drive element of the infant entertainment device illustrated in FIG. 2.
Figure 18:
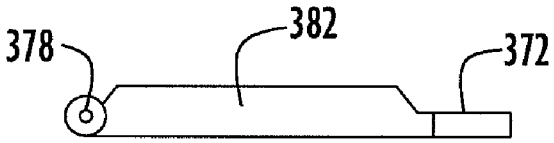
Figure 19:
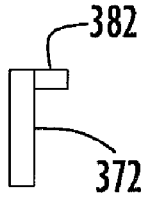

Referring to FIGS. 17-19, an embodiment of a drive element or linkage is illustrated. In this embodiment, drive element 280 includes a body 370 with ends 372 and 374. End 372 defines an opening 376 that resembles a slot. The opening 376 is configured to receive the coupler 346 of the drive member 340. Proximate to end 374 are connectors 378 and 380 that are configured to engage respective couplers 264, 265, 266, and 267 disposed on the back surface 260 of the movable object 250. The drive element 280 includes a guide portion 382 that extends laterally to on side of the drive element 280. The guide portion 382 is configured to be slidable in a slot or notch formed in surface 191 to guide the movement of the drive element 280. In other embodiments, the drive element or linkage can have a different shape or configuration.

Referring to back to FIG. 11, the drive mechanism 310 includes a drive portion 400 that impart motion to movable object 230. Drive portion 400 includes elongate members 410 and 420 that move upwardly and downwardly along the direction of arrow "O." The elongate members 410 and 420 are coupled to and engaged by cam members 326 and 324, respectively. As the shaft 314 rotates, the cam members 324 and 326 cause the elongate members 420 and 410 to move up and down. The offset positioning of the cam members 324 and 326 results in the elongate members 410 and 420 being slightly offset from each other, in a vertical direction, most of the time. A coupler 430 is pivotally coupled to each of the elongate members 410 and 420. As the elongate member 410 is moved upwardly more than elongate member 420, the coupler 430 is tilted to one side. As elongate member 410 is moved downwardly more than elongate member 420, the coupler 430 is tilted to the other side. The tilting or arcuate rotation of the coupler 430 imparts the arcuate movement of the movable object 230 along the directions of arrows "E" and "F" in FIG. 4. A connector 440 is provided to couple the movable object 230 to the coupler 430. The coupler 430 is also moved along the direction of arrow "D" in FIG. 4. One or more guide members 450 can be provided to control the movement of the elongate members 410 and 420.

Figure 20:
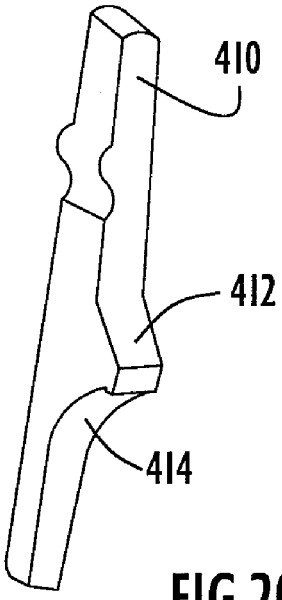
FIG. 20 illustrates a perspective view of an embodiment of an elongate member of the infant entertainment device illustrated in FIG. 2.

Referring to FIG. 20, an embodiment of an elongate member 410 is illustrated. As shown, elongate member 410 includes a body portion 412 that includes an engagement surface 414. As the output shaft 314 rotates, the cam member 324 slidably engages the surface 414 and causes movement of the elongate member 410 upwardly. The elongate member 410 can be moved in the opposite direction by gravity, which causes the surface 414 of the elongate member 410 to maintain contact with an outer surface of the cam member 324. In different embodiments, the elongate member may include various structures or features and have any type of configuration. Elongate members 410 and 420 can be made of a molded plastic material.

Figure 21:
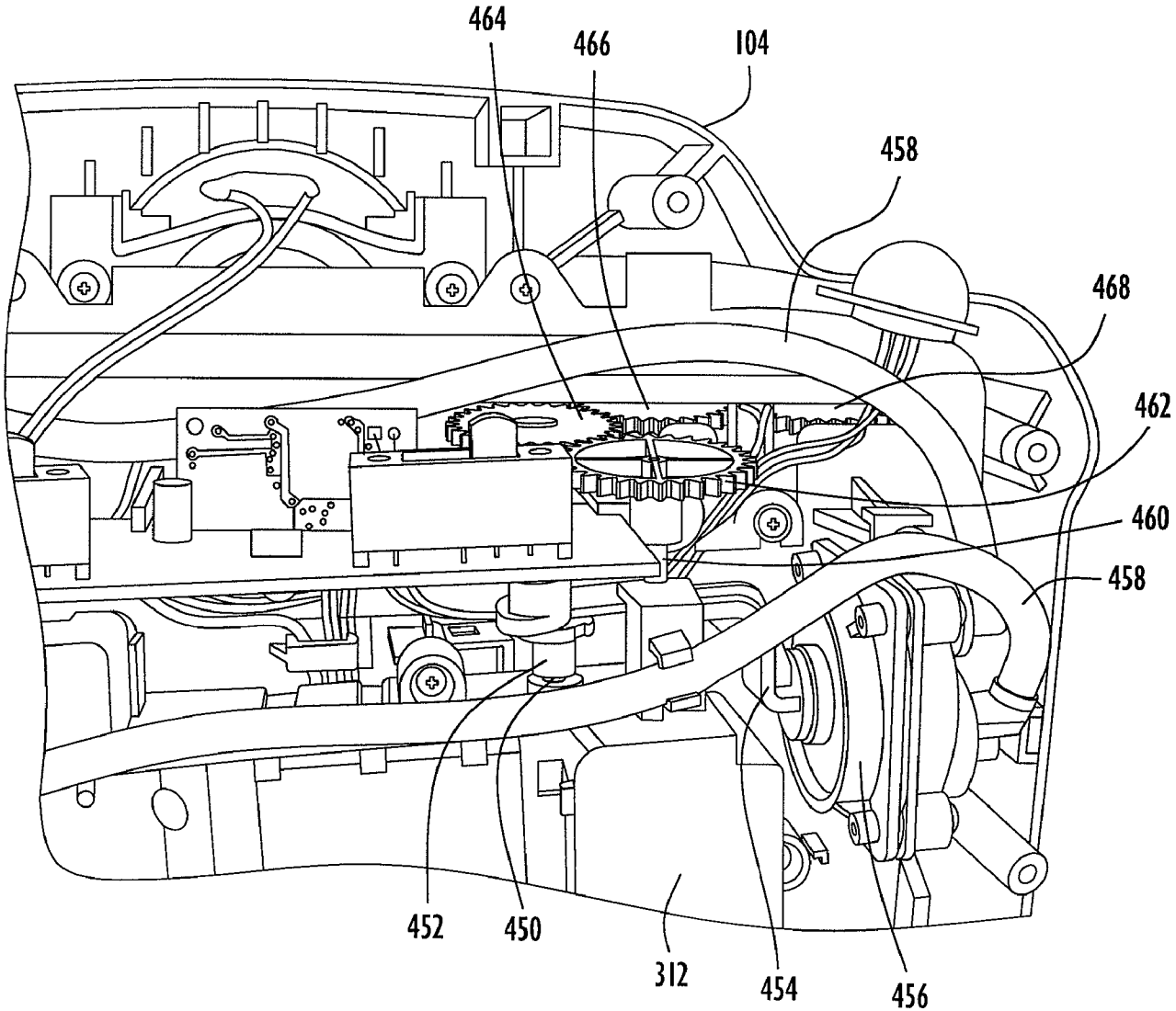
FIG. 21 illustrates a close-up rear view of some of the components of the drive mechanism of the infant entertainment device illustrated in FIG. 2.

Referring to FIG. 21, a rear view of some of the components of the infant entertainment device is illustrated. In this embodiment, the drive mechanism 310 includes another output shaft 450 that extends out of the drive housing 312. Output shaft 450 includes an eccentrically mounted member 452 pivotally coupled thereto and to which an arm 454 is coupled. Arm 454 forms part of an air pump 456 which includes a diaphragm and is configured to pump air into tubing 458 that extend from the air pump 456 to the lower end 124 of the container 112. The air pump 456 is operated when the drive mechanism 310 is activated. Air is pumped through the tubes 458 and fed into the container, where the bubbles rise upwardly to the top surface of the liquid 114.

In this embodiment, the drive mechanism 310 includes another output shaft 460 that is operably coupled to gear 462, which engages a gear 464, which then drives gears 466 and 468. Each of the drive games 466 and 468 is coupled to one of the movable members 210 and 220. Rotation of gears 466 and 468 causes the movable members 210 and 220 to rotate along the directions of arrows "B" and "C," respectively.

While the movable objects or toy characters are illustrated as facing to the left of the infant entertainment device, the movable objects may have any orientation. The movable objects may resemble any type of aquatic character or structure.

In alternative embodiments, the movable objects and/or toy characters can have various shapes, sizes, and configurations. In alternative embodiments, the drive mechanism may be operably coupled to all or some of the movable objects via gear arrangements. In another embodiment, the bubble generating mechanism may be manually operated in order to generate bubbles in the container. In yet another embodiment, the front portion and the rear portion of the housing may be formed integrally. Also, the transparent or see-through portion may be semi-transparent.

While the invention has been described in detail and with reference to specific embodiments thereof, it will be apparent to one skilled in the art that various changes and modifications can be made therein without departing from the spirit and scope thereof. For example, it is to be understood that terms such as "top," "bottom," "front," "rear," "side," "height," "length," "width," "upper," "lower," "interior," "exterior," "inner," "outer," and the like as may be used herein, merely describe points of reference and do not limit the present invention to any particular orientation or configuration. Thus, it is intended that the present invention covers the modifications and variations of this invention provided they come within the scope of the appended claims and their equivalents.

What is claimed is:

1. An entertainment device comprising:

a housing defining a compartment that is defined in part by a surface;

an object disposed in the compartment, the object including at least two portions, one portion being movably mounted relative to the surface and another portion being fixedly coupled to the surface; and a drive mechanism including a drive element coupled to the movably mounted portion of the object, the drive mechanism being configured to move the drive element, and movement of the drive element causes the movably mounted portion of the object to move back and forth relative to the surface, the fixedly coupled portion of the object being spaced apart from the surface and the distance between the fixedly coupled portion and the surface being constant during operation of the drive mechanism.

2. The entertainment device of claim 1, wherein the drive element is a first drive element, the drive mechanism includes a second drive element, the movably mounted portion is a first portion and the fixedly coupled portion is a third portion, the second drive element is coupled to a second portion of the object, the drive mechanism is configured to move the first drive element and the second drive element, and the first drive element is configured to be positioned at a distance relative to the surface that is different than a distance of the second drive element relative to the surface when the drive mechanism operates.

3. The entertainment device of claim 2, wherein the first portion of the object is configured to be a different distance away from the surface than the second portion of the object when the drive mechanism operates.

4. The entertainment device of claim 3, wherein the first portion of the object is configured to be closer to the surface than the second portion of the object at one point in time and the second portion of the object is configured to be closer to the surface than the first portion of the object at another point in time during operation of the drive mechanism.

5. The entertainment device of claim 1, wherein the movably mounted portion is a first portion, and the object includes a second portion, the first portion of the object and the second portion of the object are configured to move relative to the fixedly coupled portion of the object, and during operation of the drive mechanism, a distance between the first portion of the object and the surface and a distance between the second portion of the object and the surface changes.

6. The entertainment device of claim 1, wherein the housing is configured to resemble a toy aquarium, the housing includes a transparent portion through which the object is visible in the compartment, the transparent portion including a liquid that creates the appearance of an aquatic environment, and the surface is a display surface with indicia thereon.

7. The entertainment device of claim 2, wherein the drive mechanism includes:

a drive shaft with a first cam member and a second cam member, the first cam member being disposed on the drive shaft at a different position as compared to a position of the second cam member, the drive shaft being mounted for rotation;

the first cam member being configured to impart reciprocating motion to the first drive element and to the first portion of the object; and the second cam member being configured to impart reciprocating motion to the second drive element and to the second portion of the object.

8. The entertainment device of claim 7, wherein the first cam member and the second cam member are configured to be at different positions with respect to each other as the drive shaft rotates, thereby varying the distance between the first portion of the object and the surface and the distance between the second portion of the object and the surface.

9. The entertainment device of claim 1, wherein the housing includes a transparent portion through which the object disposed in the housing can be seen, and the drive mechanism includes a rotating shaft that generates linear movement of the movably mounted portion of the object relative to the surface, the movably mounted portion of the object being configured to move toward and away from the transparent portion of the housing.

10. The entertainment device of claim 1, wherein the object has a front surface and an opposite rear surface, the front surface including indicia disposed thereon, the drive element is coupled to the rear surface of the object, and the movement of the drive element moves the front surface toward a front of the housing.

11. The entertainment device of claim 2, wherein the object has a front surface and an opposite rear surface, the front surface including indicia disposed thereon, the first drive element is coupled to the rear surface of the object, and movement of the first drive element is along a direction back and forth relative to the display surface and to the front surface of the object.

12. The entertainment device of claim 11, wherein the second drive element is coupled to the rear surface of the object at a location that is different from the coupling of the first drive element to the rear surface, and movement of the second drive element is along a direction back and forth relative to the display surface and to the front surface of the object.

13. A toy aquarium comprising:

a housing defining a compartment, the compartment having a display surface;

an object disposed in the compartment; and a drive mechanism coupled to the object at a first location and at a second location, the display surface fixedly coupled to the object at a third location, the drive mechanism being configured to move each of the first location and the second location in a back and forth relative to the display surface, the drive mechanism being configured so that the distance between the first location and the display surface can be different than the distance between the second location and the display surface during operation of the drive mechanism, the third location being spaced apart from the display surface and the distance between the third location and the display surface being constant during operation of the drive mechanism.

14. The toy aquarium of claim 13, wherein the housing includes a transparent portion including a liquid, the transparent portion defining a portion of the compartment, and the object being disposed behind the transparent portion.

15. The toy aquarium of claim 13, wherein the drive mechanism includes a rotatable shaft, a first drive element and a second drive element, the first drive element being operably coupled to the rotatable shaft to be moved thereby, the second drive element being operably coupled to the rotatable shaft to be moved thereby, the rotatable shaft being configured to move the first drive element and the second drive element in a cyclical pattern, the first drive element being configured to be out of cycle relative to the second drive element.

16. A display apparatus for simulating movement of an object, the display apparatus including a display surface, the apparatus comprising:

a flexible member having a front surface and an opposite rear surface, a first portion having a connection area on the rear surface, and a second portion fixedly coupled to the display surface; and a drive mechanism including a rotatable shaft and a linkage, the linkage having a first end connected to the connection area and having a second end connected to the rotatable shaft, wherein the first end of the linkage repeatedly moves the connection area along a direction back and forth relative to the front surface of the flexible member and repeatedly moves the first portion relative to the display surface to simulate motion of the flexible member, the second portion being spaced apart from the display surface and the distance between the second portion and the display surface being constant during operation of the drive mechanism.

17. The display apparatus of claim 16, wherein the linkage is a first linkage and the drive mechanism includes a second linkage, the connection area is a first connection area, and the flexible member includes a third portion having a second connection area, the first linkage being connected to the flexible member at the first connection area, the second linkage being connected to the flexible member at the second connection area, and each of the first linkage and the second linkage independently causes the first and third portions of the flexible member to move back and forth relative to the front surface and repeatedly moves the first and third portions relative to the display surface.

18. The display apparatus of claim 16, further comprising:

a housing, the housing including a transparent front cover and the display surface, the flexible member being disposed between the front cover and the display surface, and movement of the first portion of the flexible member simulates the swimming of the flexible member.

19. The entertainment device of claim 2, wherein the drive mechanism is configured to move the first drive element in a first direction while moving the second drive element in a second direction opposite the first direction.

20. The display apparatus of claim 16, wherein the flexible member resembles a fish, the first portion corresponds to a tail of the fish, and the second portion corresponds to the head of the fish.

* * * * *